US007439685B2

(12) United States Patent
Kim et al.

(10) Patent No.: US 7,439,685 B2
(45) Date of Patent: Oct. 21, 2008

(54) CURRENT BALANCING TECHNIQUE WITH MAGNETIC INTEGRATION FOR FLUORESCENT LAMPS

(75) Inventors: Sangsun Kim, San Jose, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 340 days.

(21) Appl. No.: 11/176,804

(22) Filed: Jul. 6, 2005

(65) Prior Publication Data

US 2007/0007908 A1 Jan. 11, 2007

(51) Int. Cl.
*H05B 41/24* (2006.01)

(52) U.S. Cl. ..... 315/277

(58) Field of Classification Search ..... 315/251, 315/252, 254, 255, 256, 276, 277, 278, 279
See application file for complete search history.

(56) References Cited

U.S. PATENT DOCUMENTS

| | | | | |
|---|---|---|---|---|
| 4,567,379 | A | 1/1986 | Corey et al. | |
| 4,574,222 | A * | 3/1986 | Anderson | 315/254 |
| 4,902,942 | A * | 2/1990 | El-Hamamsy | 315/276 |
| 5,528,192 | A | 6/1996 | Agiman et al. | |
| 5,568,371 | A | 10/1996 | Pitel et al. | |
| 5,615,093 | A | 3/1997 | Nalbant | |
| 5,619,402 | A | 4/1997 | Liu | |
| 5,757,173 | A | 5/1998 | Agiman | |
| 5,892,336 | A | 4/1999 | Lin et al. | |
| 5,923,129 | A | 7/1999 | Henry | |
| 5,930,121 | A | 7/1999 | Henry | |
| 6,104,146 | A | 8/2000 | Chou et al. | |
| 6,108,215 | A | 8/2000 | Kates | |
| 6,135,620 | A | 10/2000 | Marsh | |
| 6,181,066 | B1 * | 1/2001 | Adamson | 315/282 |
| 6,198,234 | B1 | 3/2001 | Henry | |
| 6,198,245 | B1 | 3/2001 | Du et al. | |
| 6,259,615 | B1 | 7/2001 | Lin | |
| 6,307,765 | B1 | 10/2001 | Choi | |
| 6,396,722 | B2 | 5/2002 | Lin | |

(Continued)

FOREIGN PATENT DOCUMENTS

EP 1 517 591 3/2005

(Continued)

OTHER PUBLICATIONS

Bradley, D.A., "Chapter 1: Power Semiconductors," Power Electronics, published Oct. 1995.

(Continued)

*Primary Examiner*—Douglas W. Owens
*Assistant Examiner*—Minh Dieu A
(74) *Attorney, Agent, or Firm*—Perkins Coie LLP; Zhou Lu

(57) ABSTRACT

Methods and apparatus are disclosed for balancing currents passing through multiple parallel circuit branches and in some cases through parallel fluorescent lamps. Single transformers with multiple-leg magnetic cores are wound in specific manners that simplify current balancing. Conventional three-legged EE-type magnetic cores, with disclosed windings are used to balance current in circuits with three or more parallel branches, such as parallel connected Cold Cathode Fluorescent Lamps (CCFLs).

23 Claims, 10 Drawing Sheets

Integrated magnetic core with star-delta configuration.

U.S. PATENT DOCUMENTS 6,459,216 B1 10/2002 Tsai
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,616,310 B1 9/2003 Marsh
6,654,268 B2 11/2003 Choi
6,657,274 B2 12/2003 Comeau et al.
6,717,372 B2 4/2004 Lin et al.
6,756,769 B2 6/2004 Bucur et al.
6,781,325 B2 8/2004 Lee et al.
6,793,381 B2 9/2004 Marsh
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 3/2005 Choi
6,873,322 B2 3/2005 Hartular
6,876,157 B2 4/2005 Henry
6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,034,647 B2 4/2006 Yan et al.
7,057,611 B2 6/2006 Lin et al.
7,061,183 B1 6/2006 Ball
7,061,188 B1 6/2006 Katyl et al.
7,075,245 B2 7/2006 Liu
7,095,392 B2 8/2006 Lin
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 * 2/2007 Ball ..... 315/282
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
7,291,987 B2 11/2007 Chang et al.
2002/0180380 A1 12/2002 Lin
2004/0000879 A1 1/2004 Lee
2004/0189432 A1 * 9/2004 Yan et al. ..... 336/182
2005/0030776 A1 2/2005 Lin
2005/0093471 A1 5/2005 Jin
2005/0093472 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0202635 A1 9/2006 Liu
2006/0232222 A1 10/2006 Liu et al.
2006/0279521 A1 12/2006 Lin
2006/0284568 A1 12/2006 Chang et al.
2007/0001621 A1 1/2007 Chan et al.
2007/0001627 A1 1/2007 Lin et al.
2007/0046217 A1 3/2007 Liu
2007/0047276 A1 3/2007 Lin et al.
2007/0085493 A1 4/2007 Kuo et al.
2007/0252531 A1 11/2007 Hung et al.

FOREIGN PATENT DOCUMENTS

JP 2004-335443 11/2004

OTHER PUBLICATIONS

Dubey, G.K. et al, "2.6.2 Parallel Connection," Thyristorised Power Controllers, published Aug. 1986.

Williams, B.W., "Chapter 10: Series and Parallel Device Operation, Protection, and Interference," Power Electronics: Device, Drivers, Applications and Passive Components, published Sep. 2002.

Kamath, et al., "A Novel, Reduced Rating Active Filter For 3-Phase, 4-Wire Loads," Dept of EE, University of Minnesota, Minneapolis, MN 55455.

Kim, Sangsun, "Active Zero-Sequence Cancellation Technique in Unbalanced Commercial Building Power System," LITEON Inc, Power Conversion SBU, 8203 Willoe Place South, Houston, TX 77070 USA.

Kim, Sangsun, "New Mulitple DC-DC Converter Topology with a High Frequency Zig-Zag Transformer," LITEON Inc, Power Conversion SBU, 8203 Willow Place South, Huston, TX 77070 USA.

* cited by examiner

A typical multi-lamp system driven by an inverter.

(A)

(B)

Available current balancing techniques.

An embodiment using an integrated magnetic core for a 3-lamp system.

(A)
3 transformers with 6 windings (IM I)

(B)
2 transformers with 4 windings (IM II)

A structure of an integrated transformer with 3 leg core.

4 windings on a 3-leg integrated magnetic core (IM-III)

An example of a 3-Lamp Current Balancing Technique with a single magnetic core

Integrated magnetic core with star-delta configuration.

Multi-leg magnetic core with zig-zag connection.

Multi-leg magnetic core with star-delta connection.

IM(I) has N legs with 2N windings; 2 windings on each leg (N>=3).
IM(II) has more than M legs with 2M windings; 2 windings on each leg (M>=2).
Number of wound legs is SxN+TxM.

A transformer configuration for multi-lamp current balancing.

Multi-leg magnetic core with star-open delta connection.

CURRENT BALANCING TECHNIQUE WITH MAGNETIC INTEGRATION FOR FLUORESCENT LAMPS

TECHNICAL FIELD

The embodiments described below relate, particularly, to current balancing in Cold Cathode Fluorescent Lamps (CCFLs) and, generally, to current balancing in multiple parallel branches of a circuit.

BACKGROUND

Fluorescent lamps provide illumination in typical electrical devices for general lighting purposes and are more efficient than incandescent bulbs. A fluorescent lamp is a low pressure gas discharge source, in which fluorescent powders are activated by an arc energy generated by mercury plasma. When a proper voltage is applied, an arc is produced by current flowing between the electrodes through the mercury vapor, which generates some visible radiation and the resulting ultraviolet excites the phosphors to emit light. In fluorescent lamps two electrodes are hermetically sealed at each end of the bulb, which are designed to operate as either "cold" or "hot" cathodes or electrodes in glow or arc modes of discharge operation.

Cold cathode fluorescent lamps (CCFLs) are popular in backlight applications for liquid crystal displays (LCDs). Electrodes for glow or cold cathode operation may consist of closed-end metal cylinders that are typically coated on the inside with an emissive material. The current used by CCFLs is generally on the order of a few milliamperes, while the voltage drop is on the order of several hundred volts.

CCFLs have a much longer life than the hot electrode fluorescent lamps as a result of their rugged electrodes, lack of filament, and low current consumption. They start immediately, even at a cold temperature, and their life is not affected by the number of starts, and can be dimmed to very low levels of light output. However, since a large number of lamps are required for large size LCDs, balanced current sharing among lamps is required for achieving uniform backlight and long lamp life.

One means of current balancing is to drive each lamp with an independently controlled inverter, which achieves high accuracy in current sharing; however, this approach is usually complicated and expensive. Another solution is to drive all lamps with a single inverter. FIG. 1 depicts a multi-CCFL system comprising a low voltage inverter, a step-up transformer, and current balancing transformers. This technique is more cost effective. Currently there are a few current balancing transformer techniques, two of which are shown in FIGS. 2A and 2B. In these designs, the current balancing is not available under open lamp condition.

DETAILED DESCRIPTION

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

The embodiments described in this detailed description generally employ a single multiple-legged transformer with multiple windings, making it a simple and accurate circuit to achieve balanced currents through all participating lamps and to reject unwanted parasitic and harmonics. A few of the advantages of the presented embodiments are accurate current balancing, reduction of the number of magnetic cores, low manufacturing cost, small size, and current balancing under open lamp conditions.

Figure 1:
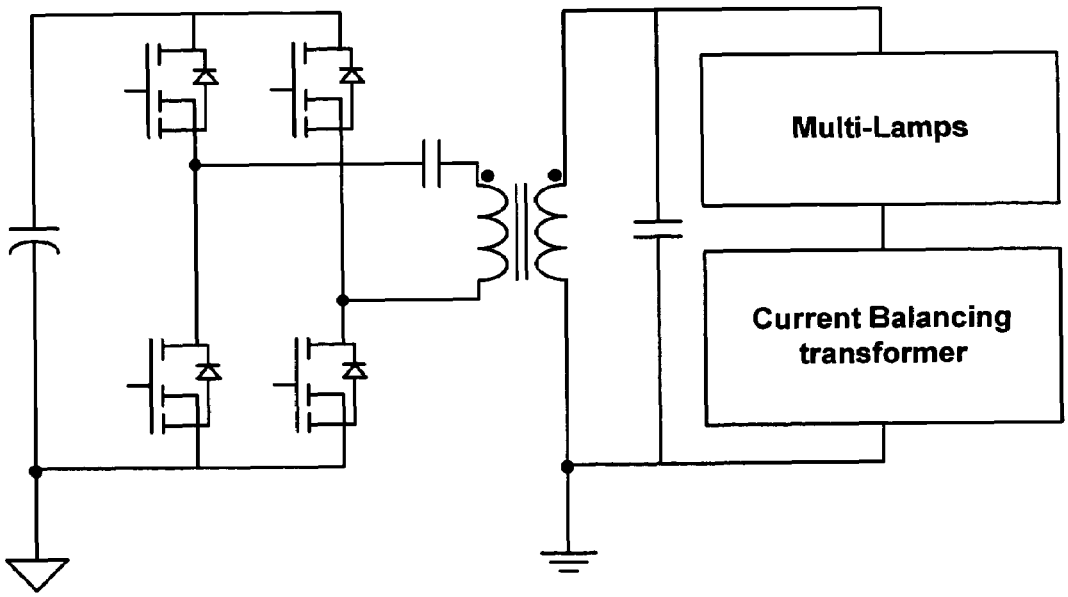
FIG. 1 illustrates a multi-lamp system driven by a single inverter.
Figure 2:
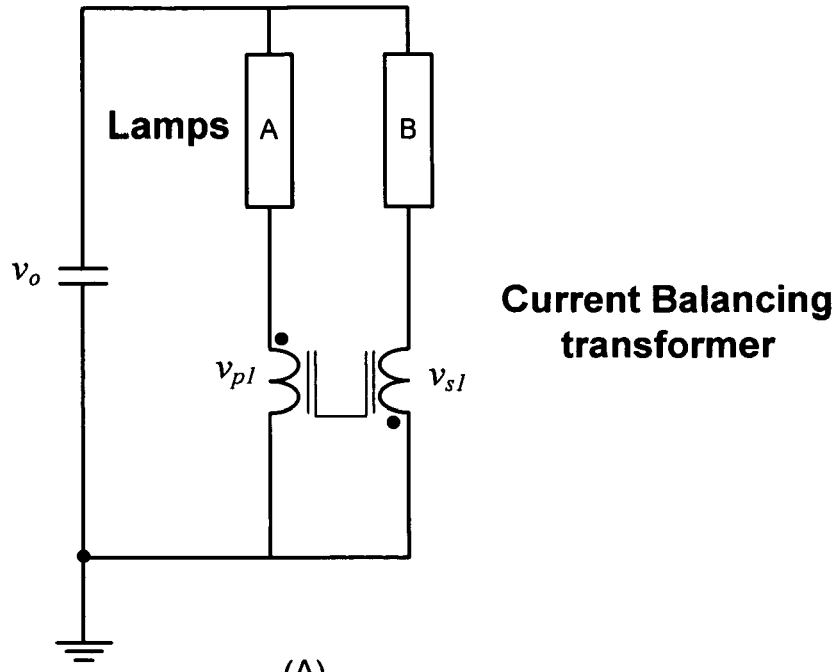
FIGS. 2A and 2B illustrate prior art multi-lamp current balancing systems.
Figure 2:
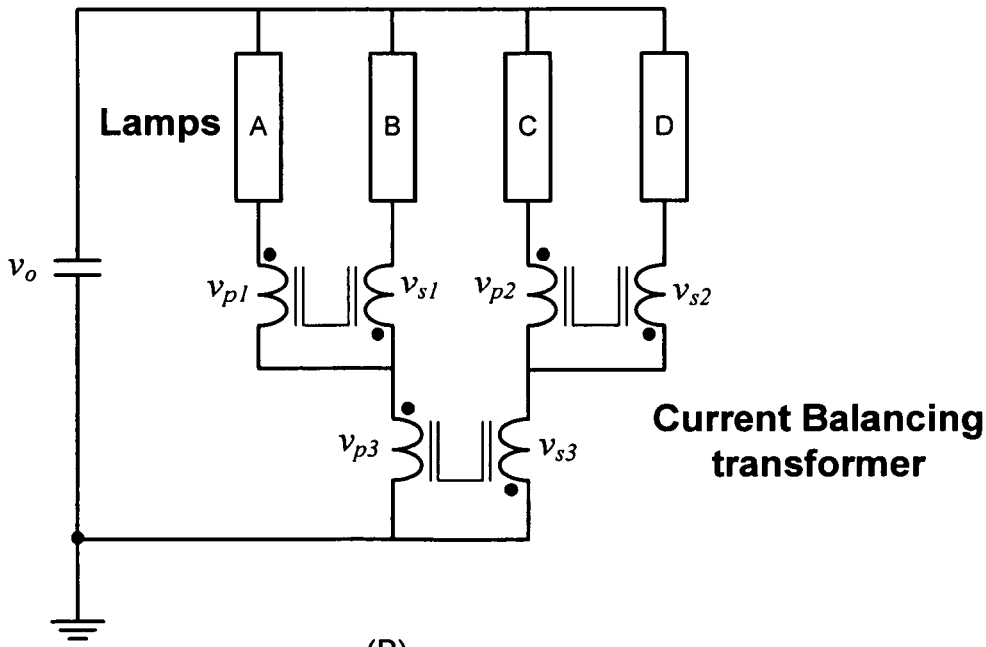
Figure 3:
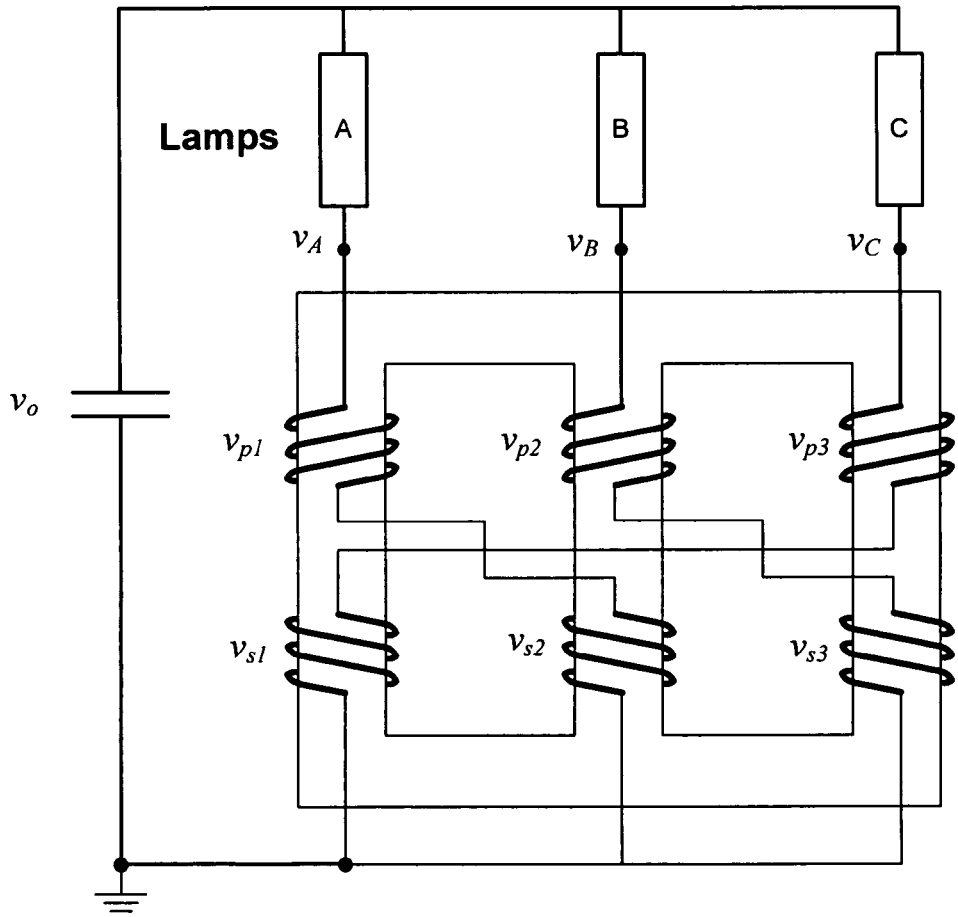
FIG. 3 illustrates an exemplary current balancing technique for multi-lamp systems, in accordance with an embodiment of the invention.

FIG. 3 shows a current balancing circuit with a zig-zag connection to balance currents passing through the lamps of a 3-lamp system. From FIG. 3, assuming that the three transformers (one on each leg) are ideal and turns ratio is 1:1, two winding voltages on the same magnetic core have the following relationship:

$$v_{p1}=-v_{s1}$$

$$v_{p2}=-v_{s2}$$

$$v_{p3}=-v_{s3} \quad (1)$$

The voltage equations on the terminals A, B, and C are:

$$\begin{bmatrix} v_A \\ v_B \\ v_C \end{bmatrix} = \begin{bmatrix} v_{p1} + v_{s2} \\ v_{p2} + v_{s3} \\ v_{p3} + v_{s1} \end{bmatrix} \begin{bmatrix} v_{p1} - v_{p2} \\ v_{p2} - v_{p3} \\ v_{p3} - v_{p1} \end{bmatrix} \begin{bmatrix} 1 & -1 & 0 \\ 0 & 1 & -1 \\ -1 & 0 & 1 \end{bmatrix} \begin{bmatrix} v_{p1} \\ v_{p2} \\ v_{p3} \end{bmatrix} \quad (2)$$

and therefore:

$$v_A+v_B+v_C=0, \quad (3)$$

and $$v_{p1}+v_{p2}+v_{p3}=0. \quad (4)$$

From equation (4) it can be concluded that three separate transformers may be integrated together to provide a more compact and a less expensive solution. The resulting transformer is a kind of autotransformer that does not provide isolation. In one embodiment the cross section of the three legs are identical and each leg has two windings and the connections are made according to FIG. 3. The magnetic core can be an EE type core since it is the most commonly used. In other embodiments, other types of balanced three leg cores may be used for achieving a balanced inductance on each leg.

Figure 4:
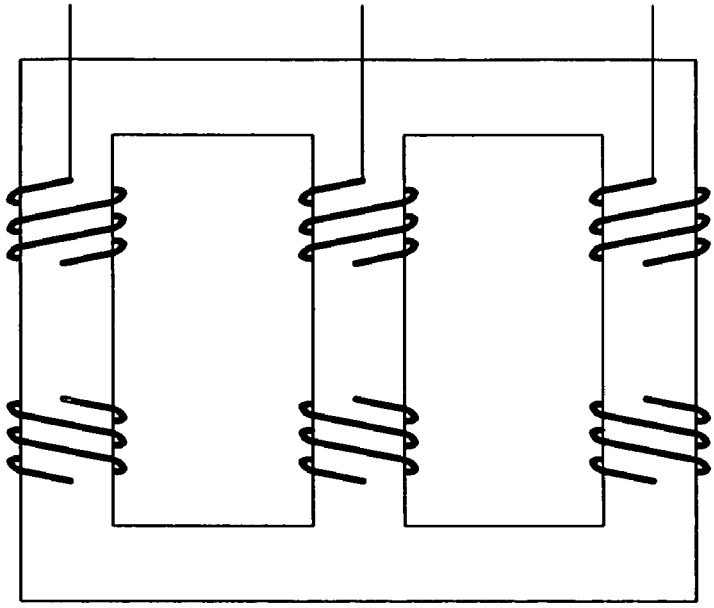
FIGS. 4A and 4B illustrate structures of two integrated transformers with 3-leg magnetic core, in accordance with two other embodiments of the invention.
Figure 4:
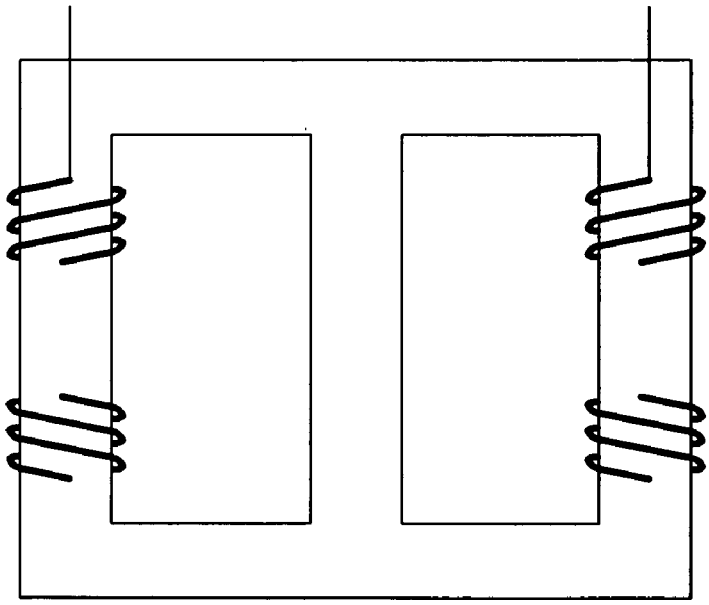

FIG. 4 illustrates a three-legged integrated transformer structure with two different winding options. In one option, as shown in FIG. 4A, all legs have windings, while in the second option, as shown in FIG. 4B, only two of the three legs have windings. Note that for the current in the three lamps to be balanced, the leg without winding does not have to be balanced with the other two legs. Therefore any available EE type magnetic core can be used for this option.

Figure 5:
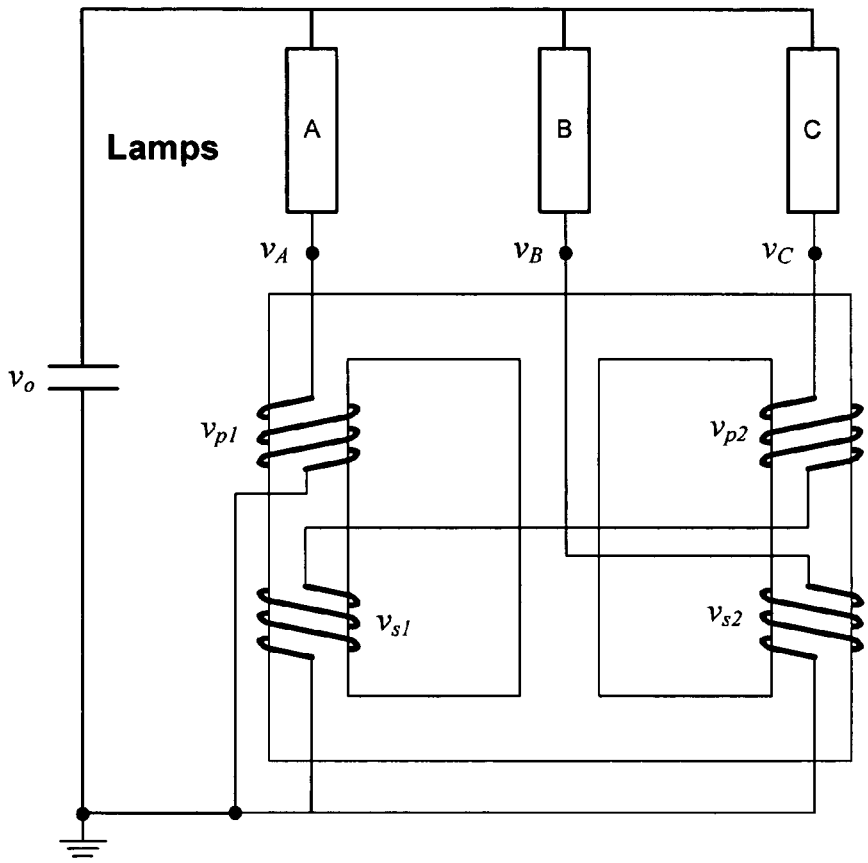
FIG. 5 illustrates an example of a 4-winding 3-Lamp current balancing technique with a single magnetic core, in accordance with yet anther embodiment of the invention.

FIG. 5 shows winding details of an embodiment, which is similar to the embodiment depicted in FIG. 4B, wherein only two legs of the integrated magnetic core have windings. This embodiment provides current balancing for a 3-lamp system.

Figure 6:
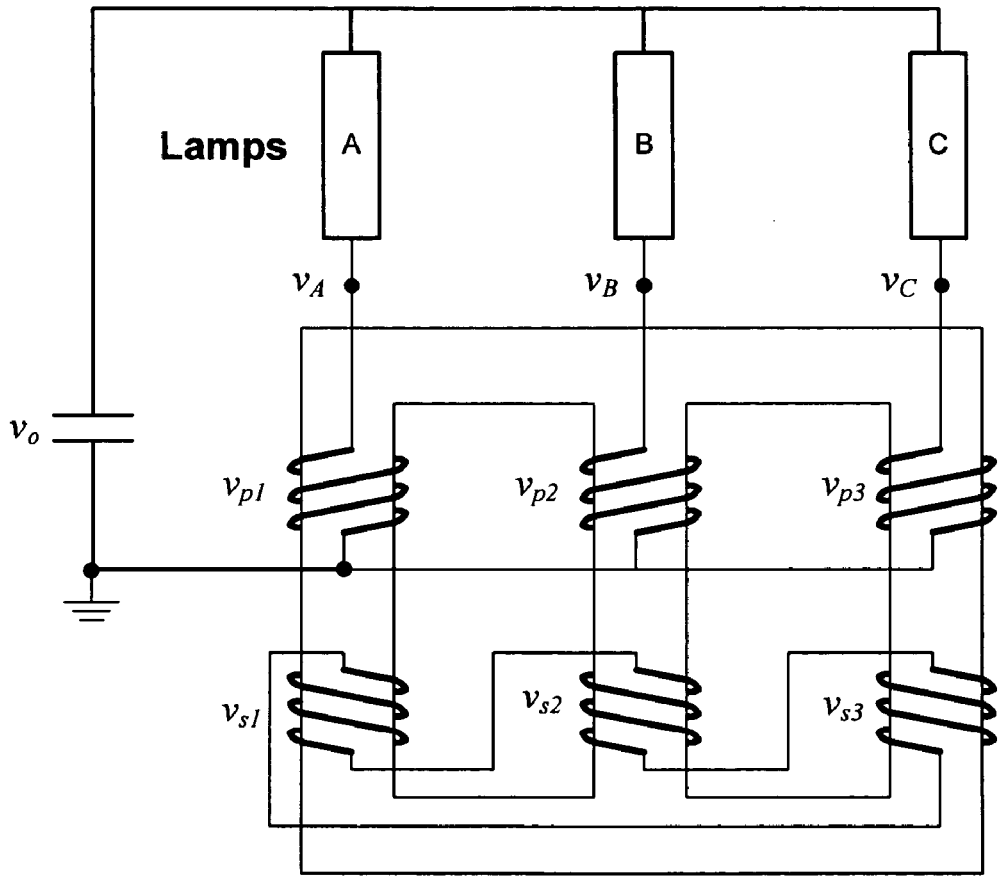
FIG. 6 illustrates a star-delta configuration of a 3-Lamp current balancing technique, using a single magnetic core, in accordance with yet anther embodiment of the invention.

FIG. 6 shows winding details of an alternative current balancing transformer with a star-delta connection for balancing the current in a 3-lamp system. As seen in FIG. 6, the magnetic core in this embodiment is also integrated. The turn-ratio of the transformer is not necessarily 1 to 1.

Figure 7:
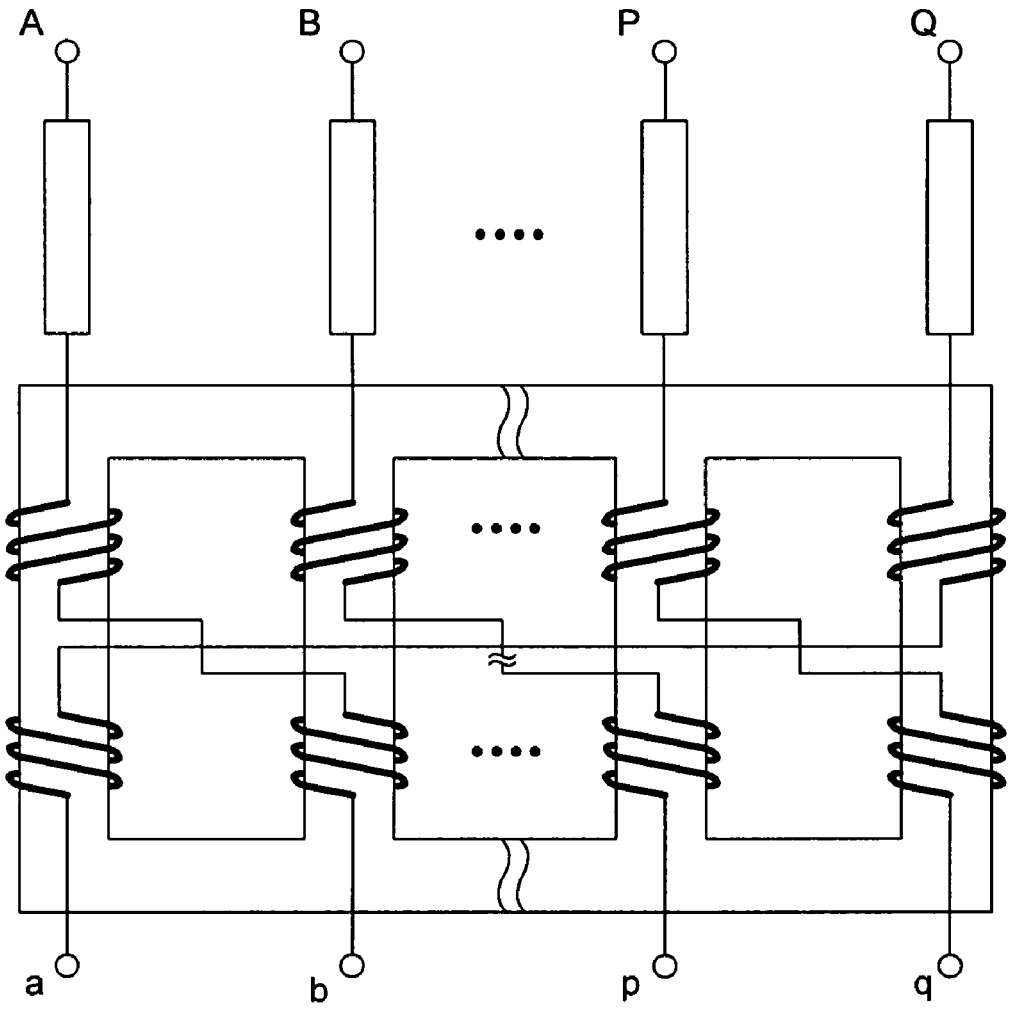
FIG. 7 illustrates a multi-leg magnetic core with zig-zag connection for current balancing in a multi-lamp system.

FIG. 7 shows that the proposed techniques of current balancing can be extended to more than 3-lamp systems by using integrated magnetic cores with more than 3 legs and zig-zag connection. Note that terminals A, B, . . . , P, and Q can be either directly connected to a high voltage capacitor or separately connected to several different capacitors. Therefore, the voltages on the terminals can either be common or phase-shifted or interleaved. In another embodiment, terminals a, b, . . . , p, and q are connected to the ground.

Figure 8:
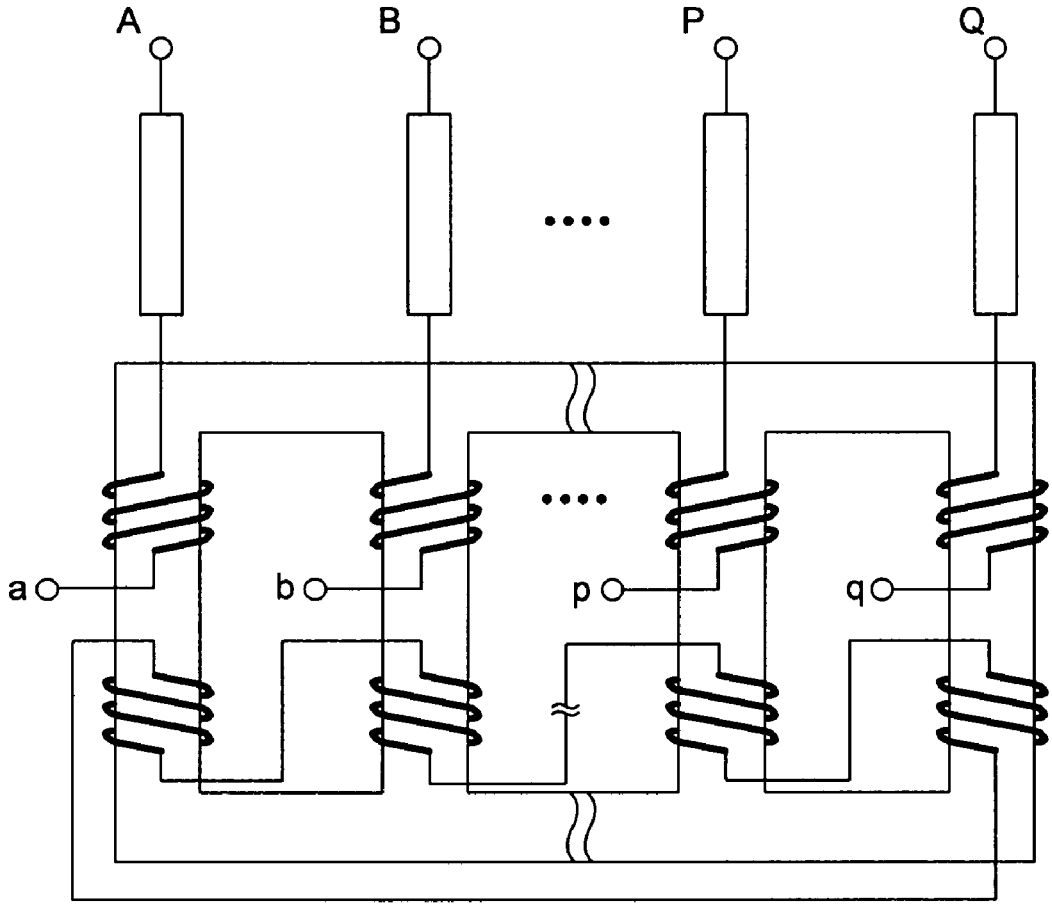
FIG. 8 illustrates a multi-leg magnetic core with star-delta connection for current balancing in a multi-lamp system.

FIG. 8 illustrates a magnetic core with more than three legs and unconnected windings that can be either connected in accordance with the general winding principles disclosed in FIG. 6. Note that terminals A, B, . . . , P, and Q can be either directly connected to a high voltage capacitor or separately connected to several different capacitors. Therefore, the voltages on the terminals could be either common or phase-shifted or interleaved. In another embodiment, terminals a, b, . . . , p, and q are connected to the ground.

In most embodiments with substantially identical leg cross sections the primary windings of the legs are substantially similar to each other and the secondary windings of the legs are also substantially similar to each other. Furthermore, all connections of the two windings of each leg are similar to the connections of the two windings of any other leg. However, the primary and the secondary windings of each leg are wound in opposite directions. In the following paragraphs, to simplify the description of different transformers, all windings which are shown to have been wound in one direction are called the primary windings, and those windings which are in an opposite direction are called the secondary windings.

In some embodiments the secondary windings of all legs are connected in series and form a loop, while one end of each primary winding is connected to one end of a respective lamp and the other end of each primary winding is connected to the ground. In some of the other embodiments the primary winding of each leg is connected at one end to one end of a lamp and at the other end to one end of the secondary winding of another leg, and the other end of the secondary windings of the legs are connected to ground. The connections of the 4-winding arrangement of FIG. 5 is an exception to these general directives; however, like other described windings, the inductance is balanced in all wound legs.

Figure 9:
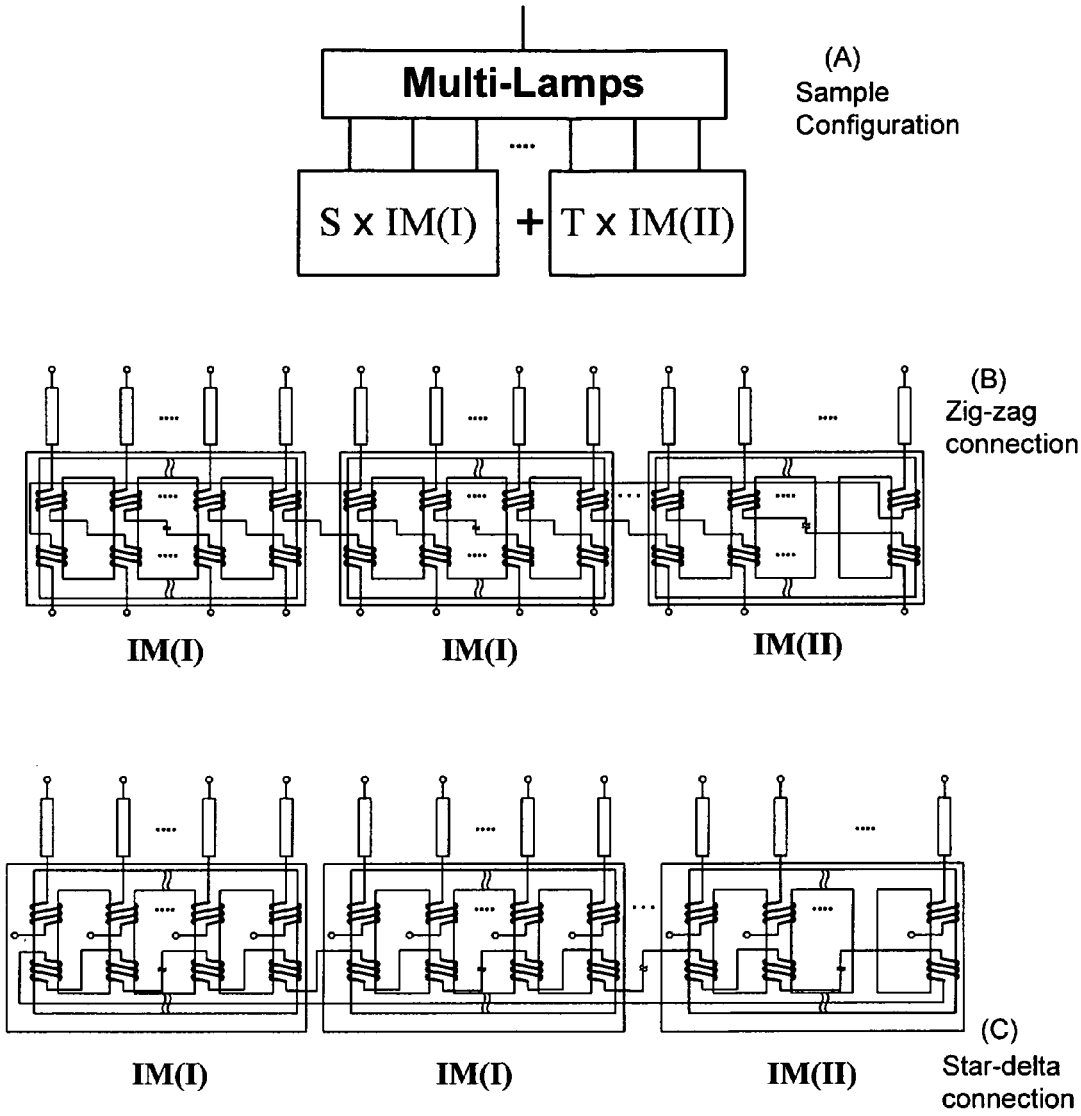
FIGS. 9A, 9B and 9C illustrate transformer configurations for balancing the current in more than three parallel lamps, using several multi-legged transformers with different windings, in accordance with other alternative embodiments of the invention.

Since it is difficult to manufacture a transformer with a large number of core legs for driving many parallel lamps, several different transformers with smaller number of legs, such as the readily available 3-leg EE type cores, can be utilized for current balancing. FIG. 9A illustrates an example of such arrangement in which at least 3-leg magnetic cores, with two windings on all legs, IM (I), or on less than all legs but more than one leg, IM (II), are used to power and balance the currents of a system with many parallel lamps. FIGS. 9B and 9C show an example of a zig-zag and a star-delta connection for the arrangement schematically illustrated in FIG. 9A. In the exemplary FIGS. 9B and 9C, S is the number of the IM (I) cores and T is the number of the IM (II) cores. Note that more than two types of cores and/or windings may be used to drive multiple parallel lamps.

Figure 10:
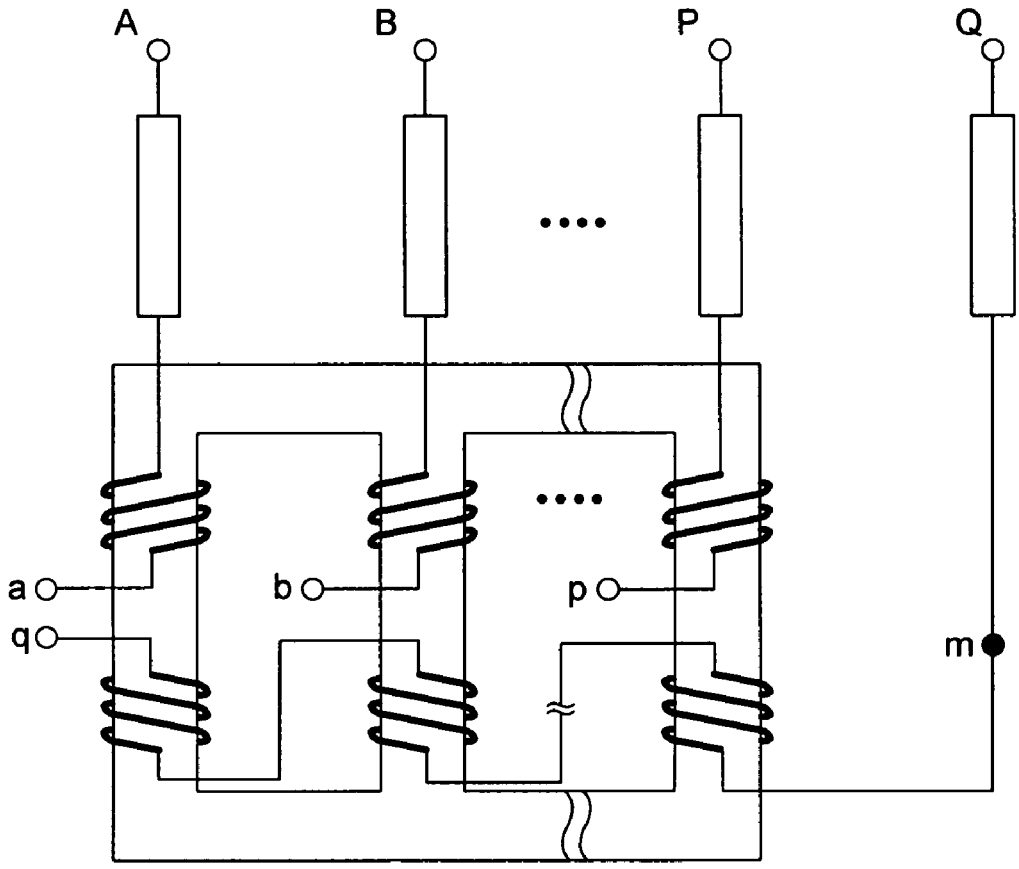
FIG. 10 shows a multi-leg magnetic core with star-open-delta connection to balance currents in more lamps than total number of magnetic core legs, in accordance with yet anther embodiment of the invention.

FIG. 10 illustrates an N-leg magnetic core with star-open-delta connection to balance currents in N+1 lamps, in accordance with yet anther embodiment of the invention. In this embodiment, the first and the second windings are configured such that the first winding of each of the N wound legs, from one similar end, is connected to one of N lamps and from another end to the ground, and the second windings of the wound legs are connected in series, wherein one end of the winding series is connected to the (N+1)th lamp and the other end of the winding series is connected to the ground.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof.

Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

The teachings of the invention provided herein can be applied to other systems, not necessarily the system described above. The elements and acts of the various embodiments described above can be combined to provide further embodiments.

Changes can be made to the invention in light of the above Detailed Description. While the above description describes certain embodiments of the invention, and describes the best mode contemplated, no matter how detailed the above appears in text, the invention can be practiced in many ways. Details of the compensation system described above may vary considerably in its implementation details, while still being encompassed by the invention disclosed herein.

As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention

We claim:

1. A current balancing integrated transformer for balancing currents in three parallel branches of a circuit, the transformer comprising:

a three-leg magnetic core; and a primary winding and a secondary winding on each of at least two legs, wherein:

the primary windings are wound in a same direction;

the secondary windings are all wound in an opposite direction with respect to the primary windings; and a configuration wherein:

if all legs have windings, the primary winding of each leg is connectable from one similar end to a fluorescent lamp and from the other end is connected or connectable to one similar end of a secondary winding of another leg, and the other end of the secondary windings are connected or connectable to a ground;

if all legs have windings, the secondary windings of all legs are connected or connectable in series so that to form a loop, and one similar end of each primary winding is connectable to a respective fluorescent lamp and the other end of each primary winding is connected or connectable to the ground, wherein the primary and secondary windings form a star-delta connection; or if two legs have windings, the primary winding of a first leg and the secondary winding of a second leg are, from one end, connectable to a first and a second fluorescent lamp and from the other end connected or connectable to the ground, and wherein the primary winding of the second leg is connectable from one end to a third fluorescent lamp and from the other end connected or connectable to one end of the secondary winding of the first leg, and the other end of the secondary winding of the first leg is connected or connectable to the ground.

2. The transformer of claim 1, wherein the leg cross sections of the three-legged core are substantially similar and the magnetic cores are EE type cores or other types of balanced three-legged cores.

3. The transformer of claim 1, wherein the primary windings are similar to each other and the secondary windings are similar to each other, or the primary windings and the secondary windings, except for winding directions, are all similar to each other.

4. The transformer of claim 1, wherein the leg cross sections and the windings of all wound legs are so designed to allow substantially balanced current to pass through all windings.

5. The transformer of claim 1, wherein said circuit branches are either directly connected to a high voltage capacitor or separately connected to several different capacitors, and wherein voltages at the points of connections of windings to the circuit branches are either common, phase-shifted, or interleaved.

6. An integrated transformer for balancing currents in more than two parallel circuit branches, the transformer comprising:

an N-leg magnetic core, wherein N is more than two; and a first winding and a second winding on each of at least two legs, wherein:

the first windings are wound in a same direction;

the second windings are all wound in an opposite direction with respect to the first windings; and a configuration wherein:

the first winding of each leg is connectable from one similar end to a fluorescent lamp and from another end connected or connectable to one similar end of a second winding of another leg, and the other end of the second windings are connected or connectable to a ground; or the second windings of all legs are connected in series and form a loop, and one similar end of each first winding is connectable to a respective fluorescent lamp and the other end of each first winding is connected or connectable to the ground.

7. The transformer of claim 6, wherein the leg cross sections of the N-legged core are substantially similar and the magnetic cores are EE type cores or other types of balanced N-legged cores.

8. The transformer of claim 6, wherein the first windings are similar to each other and the second windings are similar to each other, or wherein the first windings and the second windings, except for winding directions, are all similar to each other.

9. The transformer of claim 6, wherein the leg cross sections and the windings of all wound legs are so designed to allow substantially balanced current to pass through all windings.

10. The transformer of claim 6, wherein said circuit branches are either directly connected to a high voltage capacitor or separately connected to several different capacitors, and wherein voltages at the points of connections of windings to the circuit branches are either common, phase-shifted, or interleaved.

11. The transformer of claim 6, wherein a summation of all first or second winding voltages is equal to zero.

12. An apparatus for balancing currents in more than three parallel circuit branches, the apparatus comprising:

a number of magnetic cores, each with three or more legs, wherein each of two or more legs of each core has a first winding and a second winding, and wherein:

the first windings are all wound in an opposite direction with respect to the corresponding second windings; and a configuration wherein:

the first winding of each wound leg is connectable from one similar end to a fluorescent lamp and from another end connected or connectable to one similar end of a second winding of another wound leg, and the other end of the second windings are connected or connectable to a ground; or the second windings of all wound legs are connected or connectable in series and form a loop, and one similar end of each first winding is connectable to a respective fluorescent lamp and the other end of each first winding is connected or connectable to the ground.

13. The apparatus of claim 12, wherein the leg cross sections of the N-legged core are substantially similar.

14. The apparatus of claim 12, wherein the first windings are similar to each other and the second windings are similar to each other, or wherein the first windings and the second windings, except for winding directions, are all similar to each other.

15. The apparatus of claim 12, wherein the leg cross sections and the windings of all wound legs are so designed to allow substantially balanced current to pass through all windings.

16. The apparatus of claim 12, wherein said circuit branches are either directly connected to a high voltage capacitor or separately connected to several different capacitors, and wherein voltages at the points of connections of windings to the circuit branches are either common, phase-shifted, or interleaved.

17. The apparatus of claim 12, wherein the magnetic cores are EE type cores or other types of balanced multiple-legged cores.

18. A current balancing integrated transformer, for balancing currents in more than three circuit branches, the integrated transformer manufactured by a process comprising:

manufacturing or employing a number of magnetic cores, each with three or more legs;

winding a first coil on each of at least two legs of each core;

winding a second coil on the legs having first coils, wherein the first coil of each wound leg is wound in an opposite direction with respect to the second coil of the said leg; and assembling the transformer current balancing circuit by:

configuring the first coil of a wound leg to be connectable from one end to a fluorescent lamp and the other end connected or connectable to one end of a second coil of another wound leg, and the other end of the second coils to be connected or connectable to a ground, wherein similar ends of the first coils are connected or connectable to fluorescent lamps and similar ends of the second coils are connected or connectable to the ground; or configuring the second coils of wound legs to be connected or connectable in series and form a loop, and configuring one end of first coils to be connectable to fluorescent lamps and the other end of first coils connected or connectable to the ground, wherein similar ends of the first coils are connected or connectable to the ground and wherein the second coils are connected or connectable similarly in series.

19. The integrated transformer of claim 18, wherein at least one of the magnetic cores are an EE type core or another type of balanced three-legged core.

20. An integrated transformer for balancing currents in multiple loads, the transformer manufactured by a process comprising:

manufacturing or utilizing an N-leg magnetic core, wherein N>2;

mounting a first winding and a second winding on each of M legs of the N-leg core, wherein N≧M≧2, and wherein the first winding of each wound leg is in an opposite direction with respect to the second winding of the said leg;

configuring the first and the second windings of the M wound legs of the N-leg core by:

arranging the first winding of each wound leg to be connectable, from one similar end, to a load and from another end connected or connectable to one similar end of a second winding of another leg, and the other end of the second windings to be connected or connectable to a ground; or arranging the second windings of the wound legs to be connected or connectable in series to form a loop, and one similar end of each first winding connectable to a load and the other end of each first winding connected or connectable to the ground.

21. A method of manufacturing a current balancing integrated transformer comprising:

manufacturing or using a number of Ni magnetic cores, wherein "i" is a core identification number and Ni>2;

winding a first coil on each of M legs of each core, wherein N≧M≧2;

winding a second coil on the legs with a first coil, wherein the first coil of each leg is wound in an opposite direction with respect to the second coil of the said leg; and constructing a current balancing circuit by:

configuring the first coil of each wound leg to be connectable, from one similar end, to a circuit load and from the other end connected or connectable to one similar end of the second coil of another wound leg, and the other end of the second coils to be connected or connectable to a ground; or configuring the second coils of wound legs, to be similarly connected or connectable in series to form a loop, and one similar end of the first coils connectable to circuit loads and the other ends of first coils connected or connectable to the ground.

22. The integrated transformer of claim 21, wherein at least one of the magnetic cores are an EE type core or another type of balanced 3-leg core.

23. An integrated transformer for balancing currents in N+1 loads, the transformer manufactured by a process comprising:

manufacturing or utilizing an N-leg magnetic core, wherein N>2;

installing a first winding and a second winding on each of the N legs, wherein each first winding is in opposite direction with respect to the second winding of a corresponding leg;

configuring the first and the second windings by:

assembling the first winding of each of the N wound legs to be connectable, from one similar end, to one of N loads, and from another end connected or connectable to a ground; and assembling the second windings of the wound legs to be connected or connectable in series, and one end of the winding series connectable to the (N+1)th load and the other end of the winding series connected or connectable to the ground.

* * * * *